US007654259B1

(12) United States Patent
Allen

(10) Patent No.: US 7,654,259 B1
(45) Date of Patent: Feb. 2, 2010

(54) KEYSTONE-SHAPED FIREPLACE DOOR APPARATUS

(76) Inventor: Lawrence Royce Allen, P.O. Box 335, Jeffersonville, VT (US) 05464

( * ) Notice: Subject to any disclaimer, the term of this patent is extended or adjusted under 35 U.S.C. 154(b) by 0 days.

(21) Appl. No.: 11/903,045

(22) Filed: Sep. 20, 2007

Related U.S. Application Data

(60) Provisional application No. 60/963,862, filed on Aug. 7, 2007.

(51) Int. Cl.
*F23M 7/00* (2006.01)

(52) U.S. Cl. ..... 126/546; 126/545; 126/190; 126/200; 126/500; 110/173 R; 110/182; 110/180; 277/628; 277/590

(58) Field of Classification Search ..... 126/546, 126/545, 190, 197; 110/173 R, 182; 277/628, 277/630, 590
See application file for complete search history.

(56) References Cited

U.S. PATENT DOCUMENTS

| | | | | |
|---|---|---|---|---|
| 188,136 | A | 3/1877 | Hoffman | |
| 579,987 | A | 4/1897 | Jordan | |
| 881,196 | A | 3/1908 | McCall | |
| 977,388 | A | 11/1910 | Hays | |
| 1,128,206 | A | 2/1915 | Wiegand | |
| 1,213,173 | A | 1/1917 | Evans | |
| 1,453,939 | A | 5/1923 | Koenig | |
| 1,676,893 | A | 7/1928 | Eisele | |
| 2,015,485 | A | 9/1935 | Lindberg | |
| 2,483,608 | A | 10/1949 | Arany | |
| 3,782,403 | A * | 1/1974 | Bader | 137/86 |
| 4,086,906 | A | 5/1978 | Reichgut | |
| 4,498,701 | A * | 2/1985 | Queveau | 296/216.05 |
| 4,503,784 | A * | 3/1985 | Turecek | 110/176 |
| 4,574,773 | A | 3/1986 | Moughamian | |
| 4,583,517 | A | 4/1986 | Hilton et al. | |
| 4,884,556 | A | 12/1989 | Alden et al. | |
| 4,979,495 | A | 12/1990 | Delattre | |
| 5,052,371 | A | 10/1991 | Robert | |
| 5,435,101 | A | 7/1995 | Garries | |
| 5,848,631 | A | 12/1998 | DeGiovanni et al. | |
| 5,884,731 | A * | 3/1999 | Young | 296/97.4 |
| 6,125,773 | A | 10/2000 | Coble | |
| 6,913,011 | B1 * | 7/2005 | Snider | 126/9 R |

OTHER PUBLICATIONS

Cheryl Kenny, "Serenity Now", Timber Homes Illustrated, May 22, 2006, p. 54-63, Jun. 2006, F.W. Publications, Inc., Iola, WI, USA.
Lynne M. Schreiber, "Sense of Place", Beautiful Homes, Apr. 24, 2007, p. 58-69, Spring 2007, Meredith Corp., Des Moines, IA, USA.

* cited by examiner

*Primary Examiner*—Steven B McAllister
*Assistant Examiner*—Nikhil Mashruwala
(74) *Attorney, Agent, or Firm*—Thomas G. Ference

(57) ABSTRACT

A fireplace comprised of a burning chamber having an opening to a room and a vertically lifting door having a top edge, a bottom edge and opposing side edges. The door narrows in width from the top edge to the bottom edge to provide a keystone-shaped door. A frame is fitted in front of the burning chamber. The frame includes guide tracks configured to accept the edges of the door. A drive mechanism is provided to raise and lower the door within the guide tracks. The guide tracks may further incorporate a high temperature gasket to prevent airflow and promote energy efficiency when the door is closed.

18 Claims, 8 Drawing Sheets

KEYSTONE-SHAPED FIREPLACE DOOR APPARATUS

RELATED APPLICATIONS

This application claims the benefit of priority of U.S. Provisional Patent Application No. 60/963,862, filed Aug. 7, 2007 entitled "Keystone-Shaped Fireplace Door Apparatus".

FIELD OF THE INVENTION

This invention relates generally to fireplaces. In particular, the present invention is directed to a vertically lifting fireplace door apparatus comprising a keystone-shaped door and a high-temperature seal.

BACKGROUND OF THE INVENTION

A typical fireplace requires that the flue damper remain open after the fire has gone out, while the post-fire coals continue to off-gas carbon monoxide. The flue exhausts a mixture of smoke and air from the interior of the building. As the outdoor temperature drops, flue suction increases, causing even more interior heated air to be exhausted. The loss of interior heated air is a bigger problem for large fireplaces because the flue size grows proportionally with the area of the burning chamber opening. The resulting loss of heated air is a burden on the building's primary heating system. The usual remedy for this problem is to fit the fireplace with doors.

The three most common types of doors used in fireplaces are vertical swinging doors, bi-fold doors and guillotine-type doors. However, each has their own drawbacks. Take swinging doors for example, a fireplace with a large burning chamber greater than five feet in width would have a set of doors that swing greater than two and a half feet into the room. Such large doors obscure the view of the fire. Bi-fold doors protrude somewhat less, but they suffer from other problems such as requiring guide tracks that bind and it can be difficult to create air tight seals for them. Swing doors and bi-fold doors also tend to get hot and may burn the user when opening and closing them. Guillotine-type doors that slide along the wall structure of the fireplace work well at not obscuring the view of the fire; however, maintaining a seal without binding the edges of the door is a problem.

Current building codes suggested by the National Fireplace Protection Association (NFPA) require all fireplace doors be sealed to prevent airflow and promote energy efficiency. The current invention therefore aims to provide for an visually appealing fireplace door apparatus that has code compliant seals, size flexibility, convenient operation and unmatched adjustability that is not found in the prior art.

SUMMARY OF THE INVENTION

One aspect of the present invention is directed to a fireplace comprising a burning chamber; a vertically lifting door having a front face, a top edge, bottom edge and opposing side edges, the door narrowing in width from the top edge to the bottom edge; and a drive mechanism for raising and lowering the door in front of the burning chamber.

Another aspect of the present invention is directed to a fireplace comprising a keystone-shaped vertically lifting door, a frame and a burn chamber having an opening; wherein the frame is integrated with the opening and configured to accept the edges of the door; and wherein the door regulates airflow through the opening as the door is raised and lowered in front of the opening.

Yet another aspect of the present invention is directed to a fireplace comprising a burning chamber, a keystone-shaped door positioned in front of the burning chamber, guide means for guiding the door vertically in front of the burning chamber, drive means for moving the door along the guide means, and sealing means for sealing the door with the burning chamber when the door is in a closed position.

BRIEF DESCRIPTION OF DRAWINGS

The foregoing and other aspects and advantages of the invention will be apparent from the following detailed description of the invention, as illustrated in the accompanying drawings, in which.

DETAILED DESCRIPTION OF THE INVENTION

Figure 1:
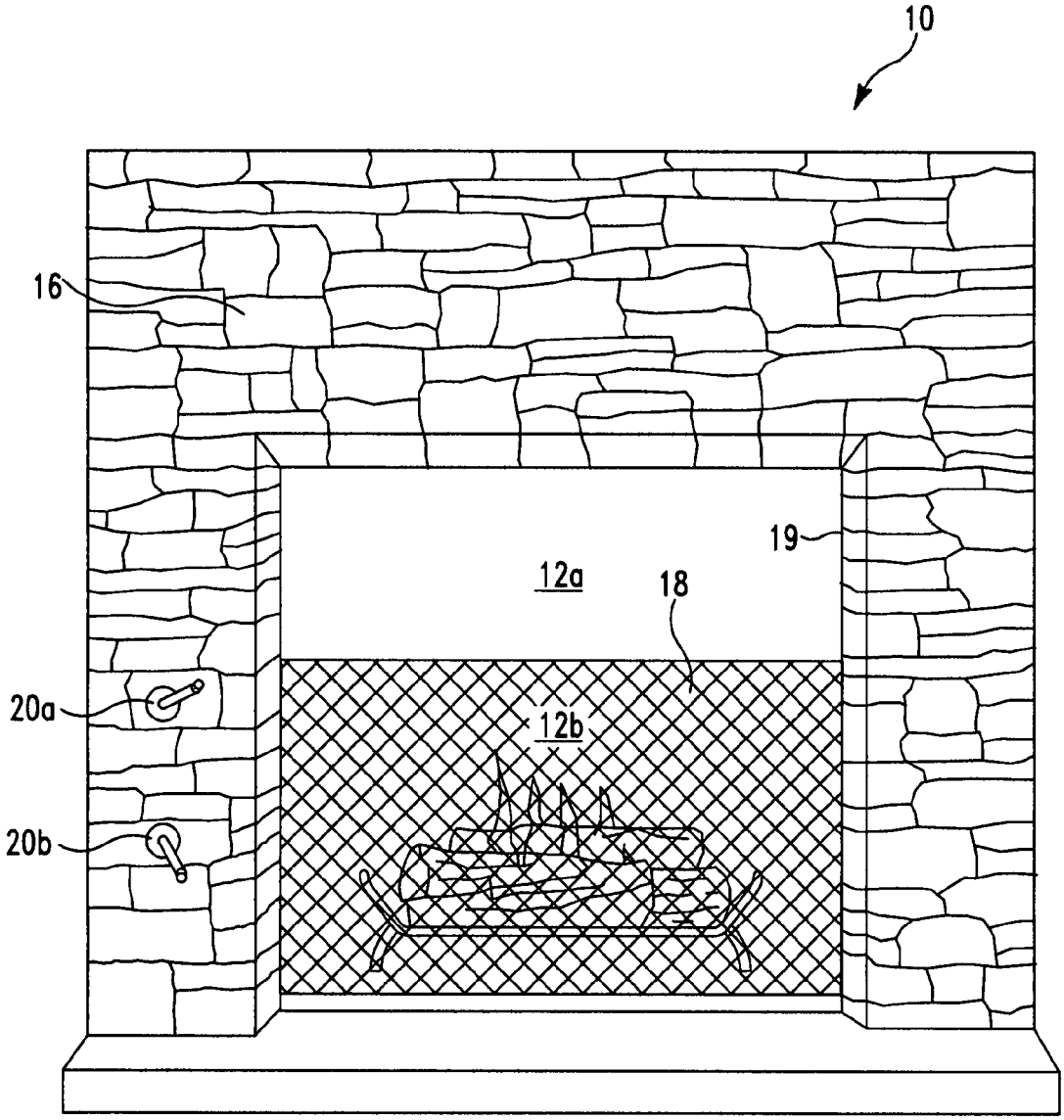
FIG. 1 is a front, perspective view of a fireplace according the present invention comprising vertically lifting doors.

FIG. 1 illustrates fireplace 10 comprising one or more vertically lifting doors. The doors preferably include (a) an outer door 12*a* having the property of preventing air flow when fireplace 10 is not in use and (b) an inner door 12*b* that is made of screening which allows air and heat to flow, but stop embers from projecting outward onto the floor. Outer door 12*a* is preferably a metal door such as annealed copper that provides colors to accent the room's colors; however, the outer door may be made of glass and used for viewing the fire within a gas fireplace. A wall structure 16 forms a burning chamber 18 for fireplace 10. Burning chamber 18 has an opening 19 to the room. Burning chamber 18 also connects with the chimney flue and damper system of fireplace 10. Wall structure 16 may be comprised of mortar, stones, fire bricks, blocks, granite veneer, or other similar suitable building materials. Doors 12*a* and 12*b* may reside within wall structure 16 or these doors may be an attachment to the front of burning chamber 18. Doors 12*a* and 12*b* can be lowered or raised independently by turning either outer door handle 20*a* or inner door handle 20*b*.

Figure 2A:
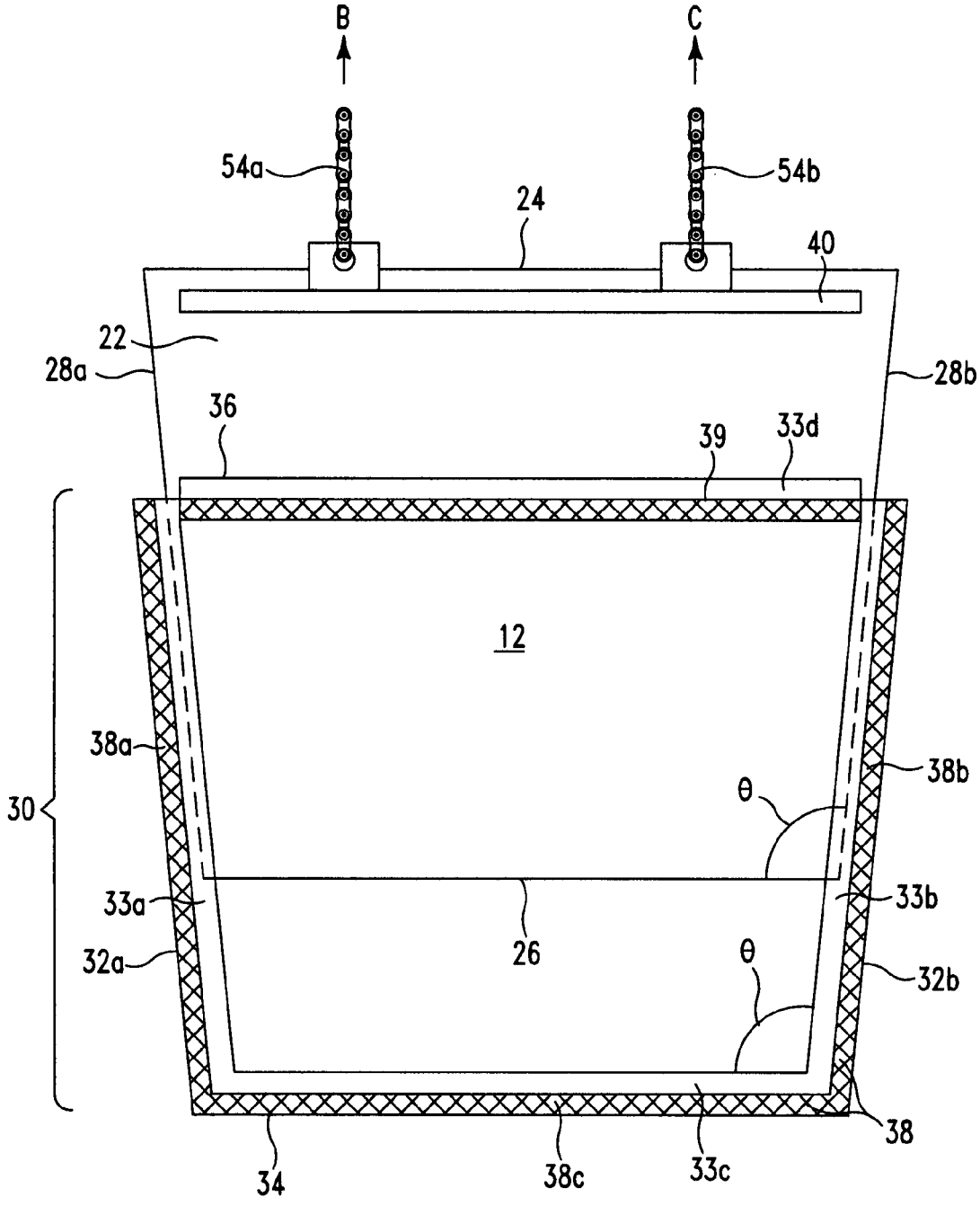
FIG. 2*a* is a front view of the keystone-shaped, vertically lifting door apparatus when the door is partially open.
Figure 2B:
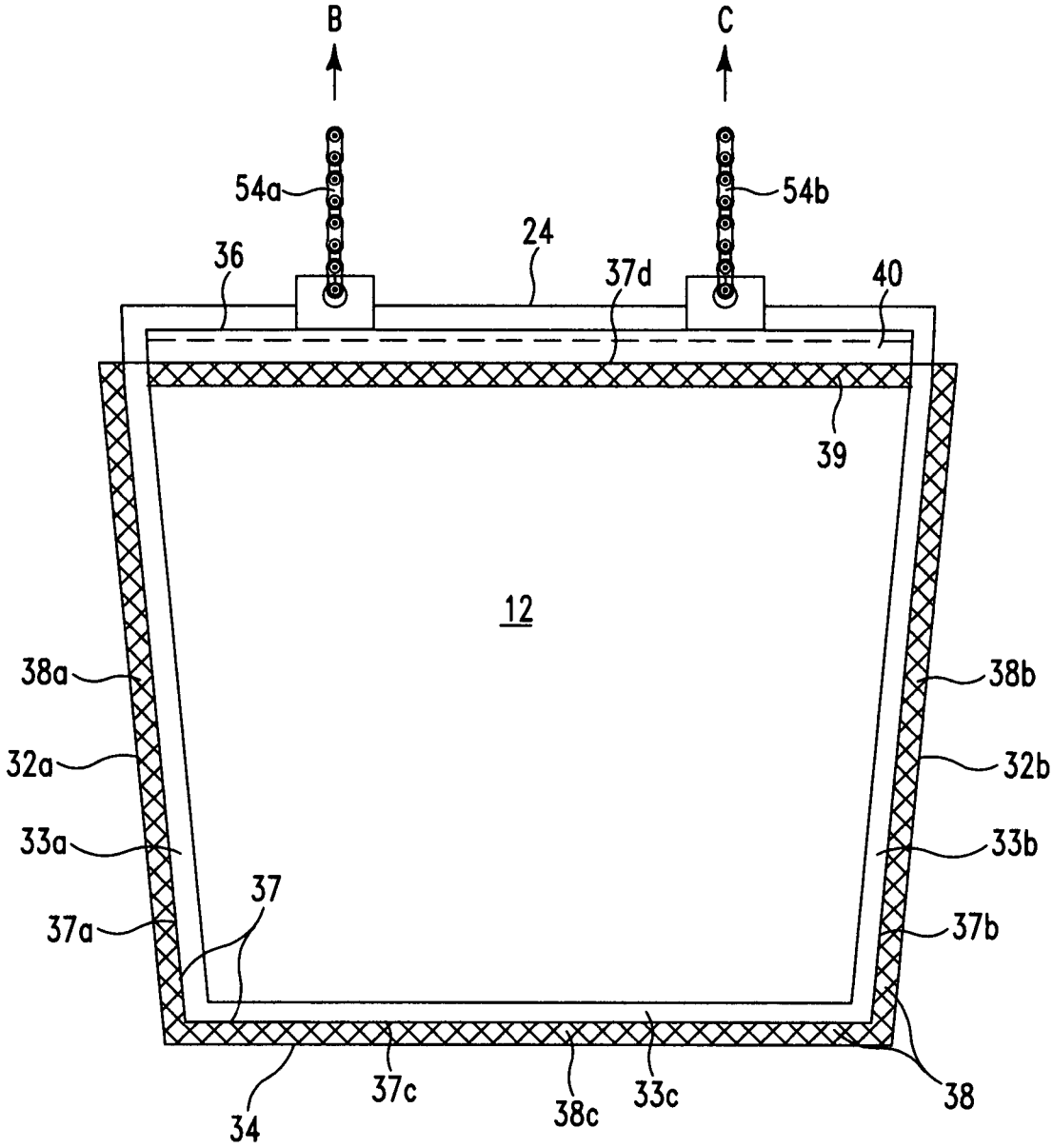
FIG. 2*b* is a front view of the keystone-shaped, vertically lifting door apparatus when the door is closed.

As shown in FIGS. 2*a* and 2*b*, door 12 has a front face 22, a top edge 24, bottom edge 26 and opposing side edges 28*a* and 28*b* that taper inwardly from top edge 24 to bottom edge 26. Wider top edge 24 and narrower bottom edge 26 provide a keystone shape to the door. Door 12 slides into a frame 30 that possesses a similar keystone shape to that of the door. Frame 30 is connected to the perimeter of room opening 19 of burning chamber 18. Frame 30 is integrated to seal with wall structure 16 so that air will not flow around the frame when door 12 is in the closed position. Frame 30 preferably has two side guide tracks 32*a* and 32*b*, a bottom track 34 and a forwardly offset top track 36. Under certain engineering situations where all four edges of the door do not require a thermal seal, frame 30 may be constructed without one or more of the tracks. The tracks may be recessed into the walls or floor of burning chamber 18 or extend into the burning chamber. Each track has a slot configured to accept an edge of door 12. Side edge 28*a* travels in left-side guide track 32*a*. Side edge 28*b* travels in right-side track 32*b*. Side guide tracks 32*a* and 32*b*, and bottom track 34, are preferably linked together to make one continuous track. The angular position of the side guide tracks 32*a* and 32*b* are adjustable. These adjustable tracks allow the builder to match vertical angle θ of the side guide tracks 32*a* and 32*b* to that of the angled taper of side edges 28*a* and 28*b* of door 12. This angular adjustment may be achieved by a pivot at the lower end of side guide tracks 32*a* and 32*b* and a locking mechanism at the top of the tracks. Vertical angle θ of side tracks 32*a* and 32*b* may be any angle greater than ninety degrees, but preferably in the range of ninety-one to ninety-three degrees.

Figure 3A:
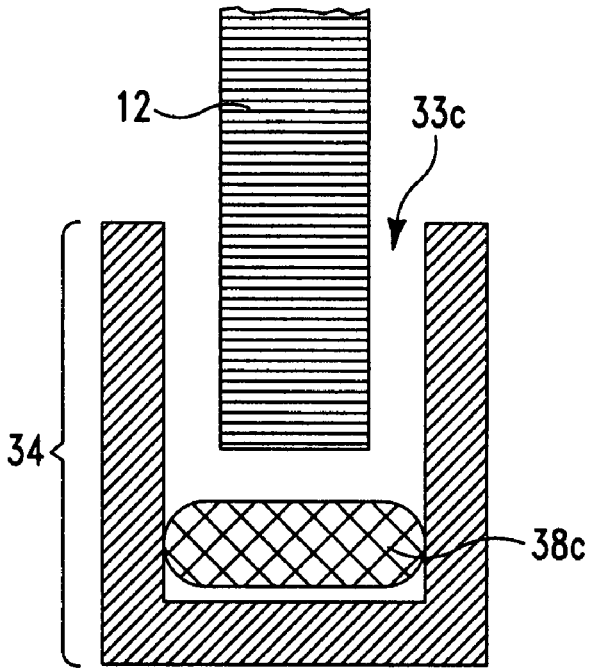
FIG. 3*a* is a sectional view of the door positioned within a track showing the door's relationship to the high-temperature gasket when the door is open.
Figure 3B:
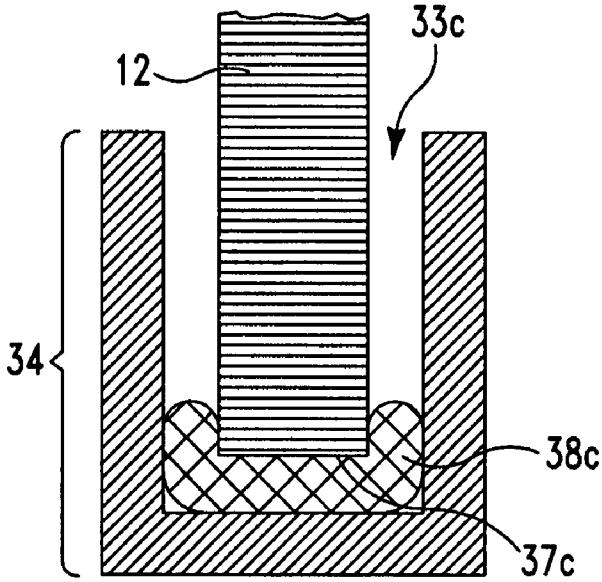
FIG. 3*b* is a sectional view of the door in FIG. 3*a* when the door is closed.

Within slot 33*a* and 33*b* of side guide tracks 32*a* and 32*b*, and slot 33*c* of bottom track 34 is mounted a lower gasket 38. Lower gasket 38 is preferably a continuous strip of replaceable thermally resistant material such as high temperature ceramic rope or a similar pliable, thermally resistant material. Lower gasket 38 can be considered to have three sections: left side gasket 38*a*, right side gasket 38*b* and bottom gasket 38*c*. Lower gasket 38 may actually be fabricated with one or more separate pieces of gasket material. An upper gasket 39 is mounted in a top slot 33*d* of the forwardly offset top track 36. A top bar 40 is mounted on the front face 22 and proximate top edge 24 of door 12. When door 12 is lowered to a closed position, FIGS. 2*b* and 3*b*, the two side edges 28*a* and 28*b*, and bottom edge 26 of the door, create a lower seal 37 with lower gasket 38. The seal is created by the outer edge of the door contacting the gasket material. This lower seal may be considered to have three sections: a left side seal 37*a*, a right side seal 37*b* and a bottom seal 37*c*. Upper gasket 39 creates an upper seal 37*d* with top bar 40 when door 12 is closed. The tapered shape of door 12 sides provides for a tight, gasketed-seal that will not bind during opening and closing door 12 and hence does not require tight tolerances. As soon as keystone-shaped door 12 is moved a few inches up from the closed position to an open position, FIGS. 2*a* and 3*a*, side edges 28*a* and 28*b* of the door disengage from lower gasket 38 and allow the door to move unrestricted. This free, unrestricted movement of the door edges combined with the taper-shape of the door, allow door 12 to be self aligning.

Figure 4:
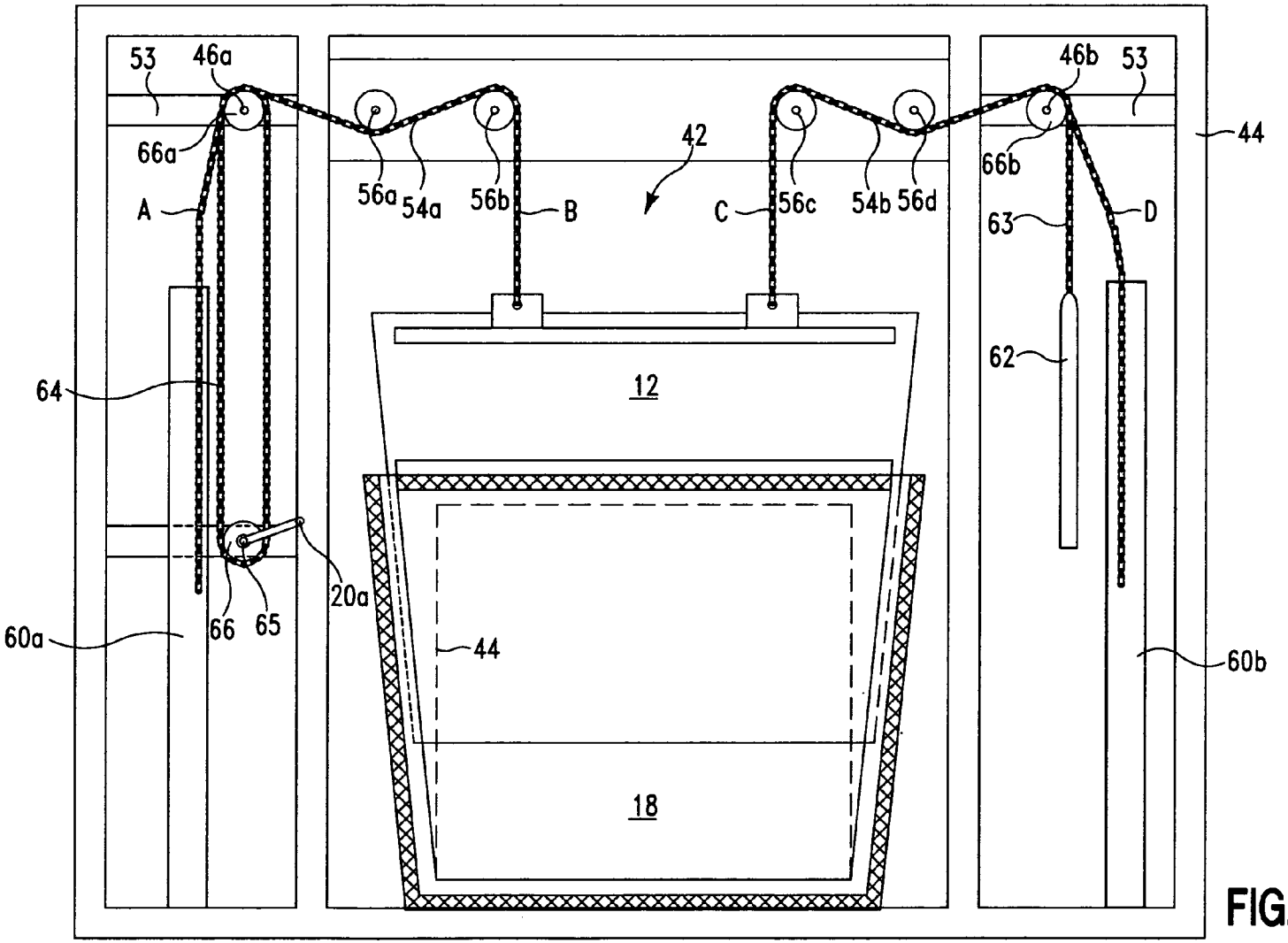
FIG. 4 is a front view of the keystone-shaped, vertically lifting door apparatus showing the drive mechanism for a one door system.
Figure 5:
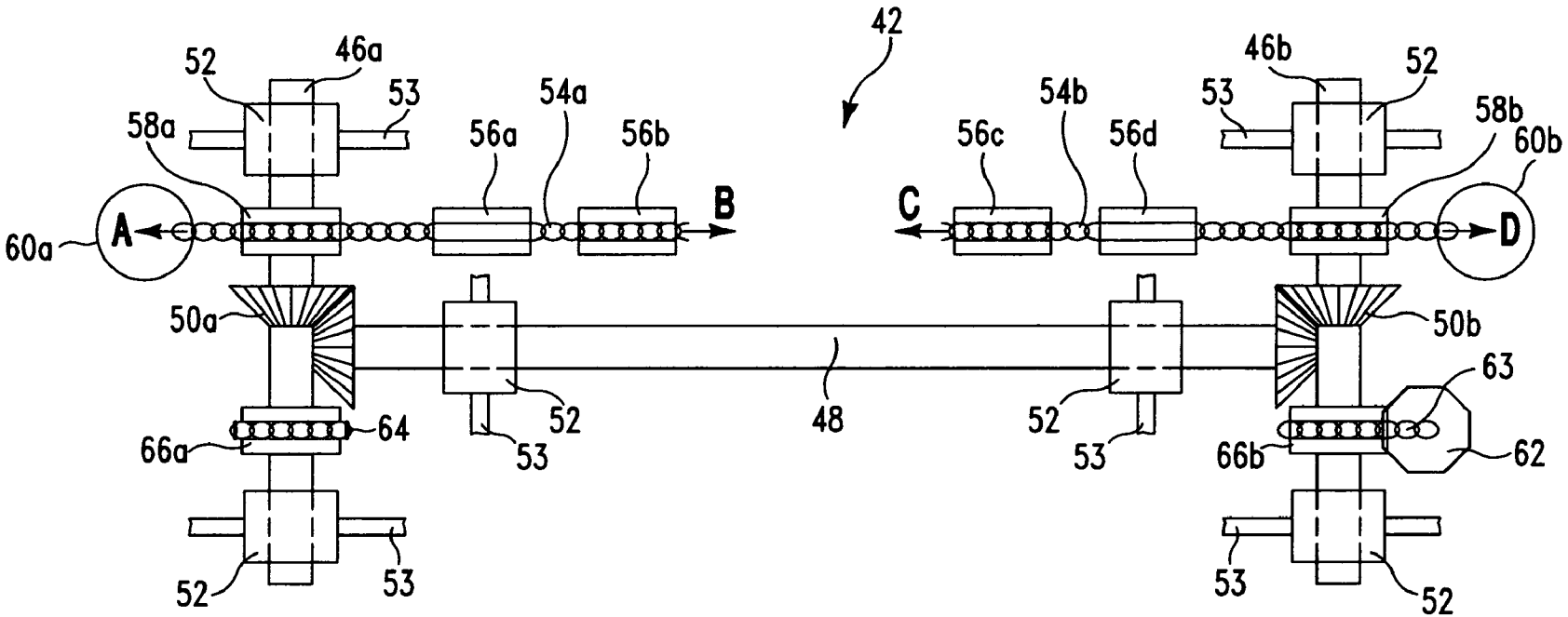
FIG. 5 is a top view of the drive mechanism shown in FIG. 4.

FIGS. 4 and 5 show drive mechanism 42 for a single door 12. In FIG. 4, the dashed line 44 delineates opening 19 of burning chamber 18 from the rest of the wall space. Drive mechanism 42 is housed behind wall 16. Drive system 42 is comprised of a set of chains, gears and shafts. In alternative configurations, drive system 42 may also include pulleys and cables. FIG. 5 shows a top down view of drive system 42.

Drive system 42 operates by rotating two opposing driven shafts 46—first driven shaft 46*a* and second driven shaft 46*b*. A cross shaft 48 connects the two driven shafts 46*a* and 46*b*. First driven shaft 46*a* and second driven shaft 46*b* spin counter too each other with the use of miter gears 50*a* and 50*b*. One side spins clockwise, the other counter clockwise. First driven shaft 46*a* and second driven shaft 46*b* are each supported by a pair of pillow block bearings 52 connected to a frame 53. Door chains 54*a* and 54*b* are fed through idler sprockets 56*a*, 56*b*, 56*c* and 56*d* to maintain a plumb lift throughout the travel of outer door 12*a*. Excess chain from the door chains 54*a* and 54*b* are housed in chain tubes 60*a* and 60*b*, respectively. To help correlate the location of chains between FIGS. 2*a*, 2*b*, 4 and 5, the chains ends have been labeled A, B, C and D. A counter weight 62 is connected to second driven shaft 46*b* by chain 63 to compensate for the weight of the door.

When the user turns outer door handle 20*a*, drive shaft 65 is turned along with gear 66 and this causes chain loop 64 to move around first gear 66*a*, which then causes first driven shaft 46*a* and miter gear 50*a* to rotate. As miter gear 50*a* rotates; cross shaft 48, miter gear 50*b*, second driven shaft 46*b*, second gear 66*b*, first door gear 58*a* and second door gear 58*b* also rotate. Door chains chain 54*a* and 54*b*, driven by door gears 58*a* and 58*b*, then move in cooperation with idler sprockets 56*a-d* to either lower or raise outer door 12 depending on the direction the user turns door handle 20*a*. Counter weight 62 provides the balance needed to keep the door at the height desired by the user.

It is important to note that drive system 42 is housed within two vertical towers on either side of burning chamber 18 and in a horizontal cross frame along the top of the burning chamber. These towers may be built from steel framing 53 and drive mechanism 42 secured to the framing. The size and exact form of the keystone-shape, vertically-lifting fireplace door apparatus is very flexible. It may be manufactured to fit any size or shape fireplace. Once in place, the mason will then build wall structure 16, burning chamber 18 and the rest of the fireplace around it. The structure can even be fabricated in a way that allows it to be an attachment to a currently existing fireplace. The installer attaches and seals the keystone-shaped, vertically lifting door system to the front of the existing fireplace and then adds a veneer to finish.

Drive system 42 may alternatively incorporate a motorized drive mechanism. In such an embodiment outer door handle 20 would be replaced by an up/down switch and a motor would be used to drive chain loop 64 instead of door handle 20*a*.

Figure 6:
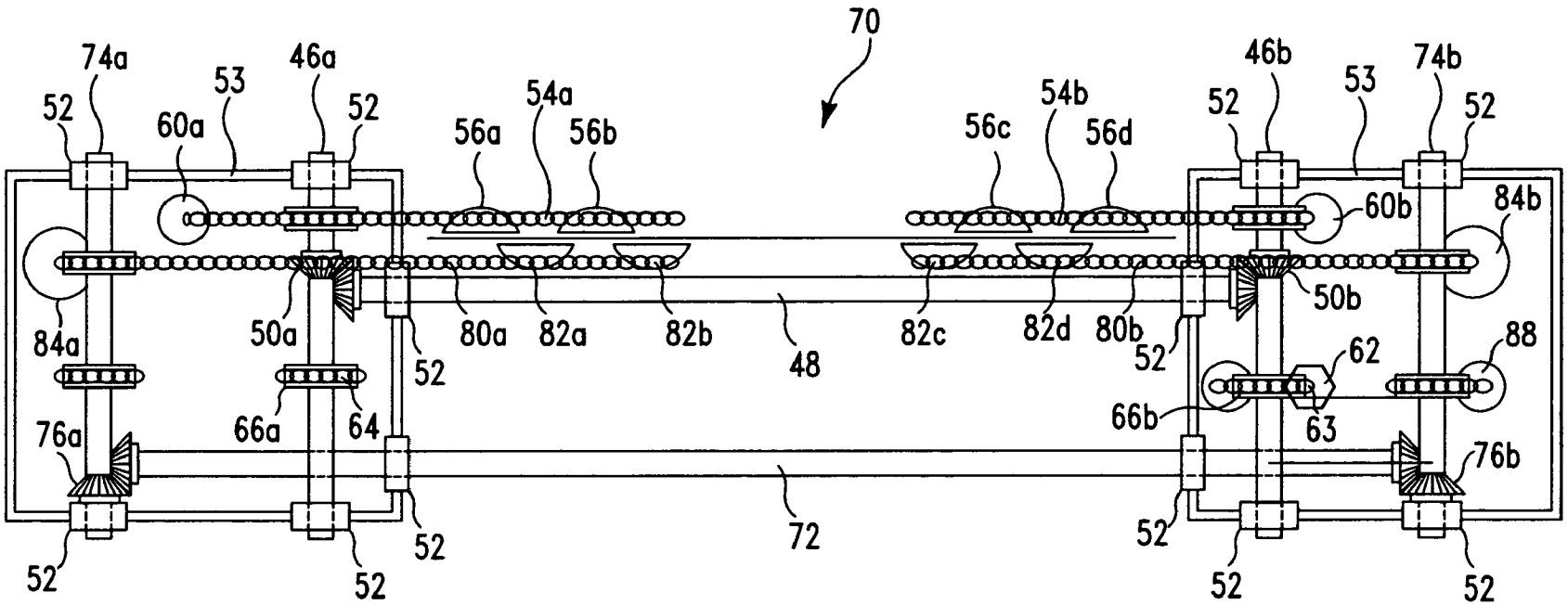
FIG. 6 is a top view of a drive mechanism for a two door system.

Although only outer door 12*a* is shown in FIG. 4, other doors such as inner screen door 12*b* may be added to fireplace 10 by providing a similar drive system, which is housed in a parallel plane to the drive system 42 used for outer door 12*a*. FIG. 6 shows such a drive system for a two door fireplace. In dual drive system 70 all the components of drive system 42 are present, but now an additional drive system has been added for the second door. The second drive system comprises a cross shaft 72, first driven shaft 74*a* and second driven shaft 74*b*. Driven shafts 74*a* and 74*b* are each supported by a pair of pillow block bearings 52 that connect to frame 53. First driven shaft 74*a* and second driven shaft 74*b* spin counter to each other with the use of miter gears 76*a* and 76*b*. Second door chains 80*a* and 80*b* are fed through idler sprockets 82*a*, 82*b*, 82*c* and 82*d* to maintain a plumb lift for inner door 12*b*. Excess chain is housed in chain tubes 84*a* and 84*b*. Counter weight 88 is connected to second driven shaft 74*b*. The components for lifting inner door 12*b* work together in the same manner as the components for outer door 12*a*.

Figure 7A:
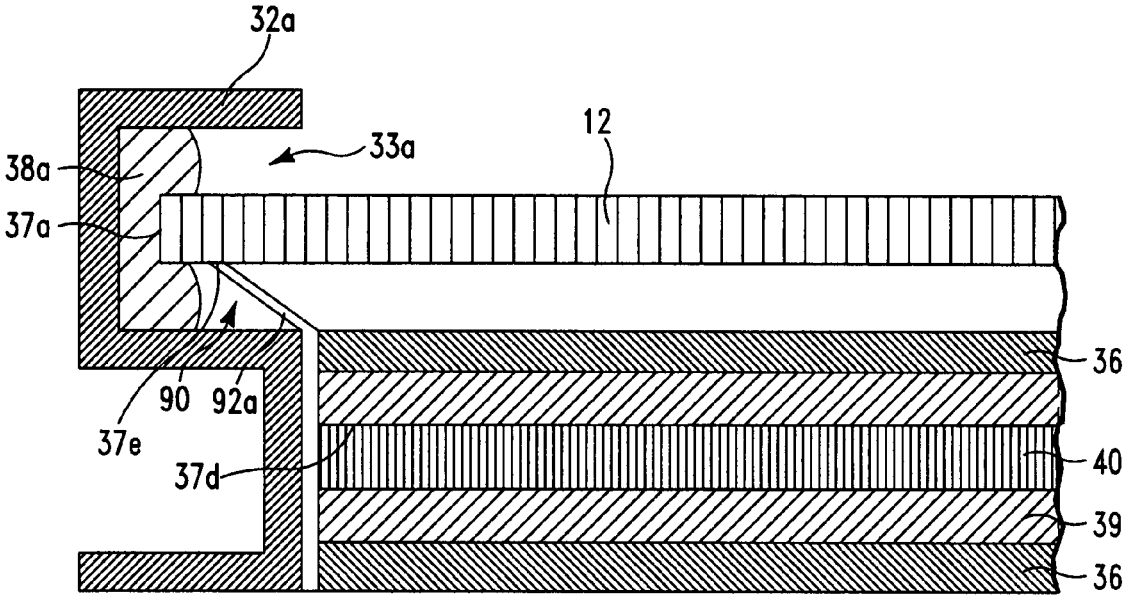
FIG. 7*a* is a top sectional view illustrating a connecting seal created by a flexible piece of flashing running between the top gasket and the front face of the door when the door is closed.
Figure 7B:
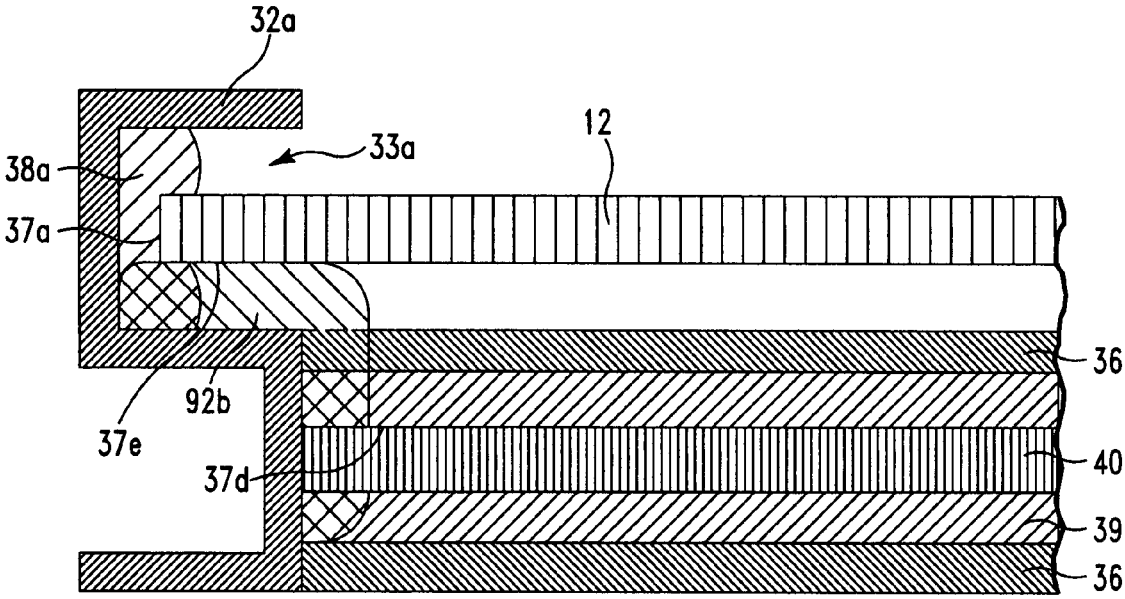
FIG. 7*b* is a top sectional view illustrating a connecting seal created by a soft pliable piece of gasket material running between the top gasket and side gasket when the door is closed.

In order to provide a continuous airflow-resistant seal around keystone-shaped door 12, it is important to have in addition to the lower seal 37 and the top seal 37*d*, a third a connecting seal 37*e*. This third seal is necessary as a result of top seal 37*d* being forwardly offset from the lower seal 37. Turning now to FIGS. 7*a* and 7*b*, it can be observed in a top-down, sectional view through door 12 at the level of top track 36 that a gap 90 exists between top gasket 39 and left side gasket 38*a*. Gap 90 will allow air to flow around door 12. Although gap 90 is a relatively small gap with a limited amount of airflow, it is possible that the speed of the air may be quite fast and produce a whistling sound. To eliminate this problem, connecting seal 37*e* is provided between top seal 37*d* and side seal 37*a*. Connecting seal 37*e* may be formed from a flexible piece of flashing 92*a* (FIG. 7*a*) or a soft pliable piece of gasket material 92*b* (FIG. 7*b*). Connecting seal 37*e* is chosen to provide minimal frictional resistance to door 12 when the door is moved up or down.

The two most important benefits of the current invention are the ability of the keystone-shaped door apparatus to (a) provide an air-resistant, code-compliant seal when the door is closed and (b) provide low frictional resistance when moving the door up and down. In addition to these benefits, several other desirable features result from the current design. One desirable feature associated with the vertical lifting door is that it facilitates up draft from the bottom edge of the door. When starting a fire, a fireplace with side swinging doors has an opening from the top to the bottom of the burning chamber. Air is usually pulled in from the bottom of the burning chamber and then blows smoke back out the top into the room before a draft has been established in the flue. This problem is virtually eliminated when using the fireplace door apparatus of the present invention. Here the door is only opened high enough to light the fire. A draft is quickly established in the flue and all of the smoke goes up the chimney. Another feature associated with the current invention is that it can be implemented for any size fireplace. However, its greatest benefit is for large fireplaces, where other types of door systems become unmanageable.

The invention is not limited to the embodiments represented and described above but includes all variants notably those concerning the size of the fireplace, the number of doors and the type of drive system used. Nothing in the above specification is intended to limit the invention more narrowly than the appended claims. The examples given are intended only to be illustrative rather than exclusive.

The invention claimed is:

1. A fireplace comprising:

a) a burning chamber having an opening;

b) a vertically lifting door having a front face, a top edge, a bottom edge and opposing side edges, said door narrowing in width from said top edge to said bottom edge;

c) a set of side guide trucks integrated with said burning chamber, wherein each said side guide track has a slot, wherein said slots are angled to seal with said opposing side edges of said door when said door is closed;

d) pivots at the lower end of said side guide tracks, wherein the vertical angles of said side guide tracks are adjustable around said pivots to allow the taper of said slots to match the taper of said side edges; and e) a drive mechanism for raising and lowering said door within said slots in front of said burning chamber.

2. A fireplace as recited in claim 1, further comprising a bottom track configured to accept said bottom edge.

3. A fireplace as recited in claim 2, wherein said side guide tracks and said bottom track form one continuous track.

4. A fireplace as recited in claim 2, wherein said side guide tracks and said bottom track are integrated to seal with said burning chamber.

5. A fireplace as recited in claim 2, further comprising a thermal gasket within said side guide tracks and said bottom track for preventing airflow around said door when closed.

6. A fireplace as recited in claim 1, wherein sad door further comprises a top bar mounted on said front face and proximate said top edge.

7. A fireplace as recited in claim 6, further comprising a forwardly offset top track having a top slot configured to accept said top bar.

8. A fireplace as recited in claim 7, further comprising a thermal gasket in said forwardly offset top slot.

9. A fireplace as recited in claim 7, further comprising a connecting seal between said side guide tracks and said forwardly offset top track.

10. A fireplace as recited in claim 1, wherein said drive mechanism comprises at least one from the group including a handle, a pulley, a cable, a chain, a gear, a shaft, a counter weight and a motor.

11. A fireplace as recited in claim 1, wherein said door regulates airflow through said opening as said door is raised and lowered in front of said burning chamber.

12. A fireplace as recited in claim 1, wherein said vertically lifting door is an attachment to the outside of said burning chamber.

13. A fireplace as recited in claim 1, wherein said fireplace includes a plurality of said vertically lifting doors each in a parallel plane.

14. A fireplace as recited in claim 1, wherein said slots run the length of said side guide tracks.

15. A fireplace as recited in claim 1, wherein said slots have a set with wider than the thickness of said door.

16. A fireplace as recited in claim 1, wherein when said door is not closed said door hangs freely with said opposing side edges within said side slots.

17. A fireplace as recited in claim 1, further comprising a locking mechanism at the upper end of said side guide tacks for locking said side guide tracks to a desired angle.

18. A fireplace as recited in claim 1, wherein when said door is closed a seal is made in the same plane as defined by the plane of said door.

* * * * *